US009808923B2

(12) United States Patent
Hu

(10) Patent No.: US 9,808,923 B2
(45) Date of Patent: Nov. 7, 2017

(54) NAIL MACHINE WITH EFFORT-SAVING MECHANISM

(71) Applicant: APEX MFG. CO., LTD., Taichung (TW)

(72) Inventor: Po-Hung Hu, Taichung (TW)

(73) Assignee: Apex MFG Co., Ltd., Taichung (TW)

( * ) Notice: Subject to any disclaimer, the term of this patent is extended or adjusted under 35 U.S.C. 154(b) by 425 days.

(21) Appl. No.: 14/688,493

(22) Filed: Apr. 16, 2015

(65) Prior Publication Data

US 2016/0303726 A1 Oct. 20, 2016

(51) Int. Cl.

| | |
|---|---|
| ***B25C 5/02*** | (2006.01) |
| ***B25C 5/06*** | (2006.01) |
| ***B25C 1/00*** | (2006.01) |
| ***B27F 7/00*** | (2006.01) |
| ***B25C 5/11*** | (2006.01) |
| ***B25C 5/16*** | (2006.01) |

(52) U.S. Cl.

CPC ..... *B25C 5/11* (2013.01); *B25C 5/1606* (2013.01)

(58) Field of Classification Search

CPC ..... B25C 5/11; B25C 5/025; B25C 5/0235; B25C 5/1617; B25C 5/161; B25C 5/1606; F16B 2/185

USPC ..... 227/175.1–182.1, 107–135, 139

See application file for complete search history.

(56) References Cited

U.S. PATENT DOCUMENTS 5,407,118 A * 4/1995 Marks ..... B25C 5/085 227/132
5,497,932 A * 3/1996 Brewer ..... B25C 5/11 227/132
7,021,515 B2 * 4/2006 Elonsson ..... B25C 5/0242 227/134
2005/0082335 A1 * 4/2005 Tsai ..... B25C 5/08 227/134
2006/0138192 A1 * 6/2006 Matsukawa ..... B25C 5/0242 227/134
2007/0023474 A1 * 2/2007 Smith ..... B25C 5/0207 227/155
2007/0145094 A1 * 6/2007 Chou ..... B25C 5/11 227/132

(Continued)

FOREIGN PATENT DOCUMENTS

TW I413578 B 1/2013

*Primary Examiner* — Robert Long
(74) *Attorney, Agent, or Firm* — Muncy, Geissler, Olds & Lowe, P.C.

(57) ABSTRACT

A nail machine with effort-saving mechanism is provided, including: a shell body; an operating mechanism, disposed on the shell body and including a pressing lever, a driving rod and a linkage, the operating mechanism provided for being operated to move between a first position and a second position; an actuating member, two ends thereof having a sliding portion and an engaging portion respectively; a striking force accumulating mechanism, including a striking board and a force accumulating member, the striking board being movable between an initial position and a releasing position; wherein when the operating mechanism moves toward the second position, the engaging portion is engaged with the striking board, and the striking board moves toward the releasing position; when the operating mechanism is in the second position, the engaging portion is detached from the striking board, and the striking board moves toward the initial position.

10 Claims, 9 Drawing Sheets

(56) References Cited

U.S. PATENT DOCUMENTS

| | | | | |
|---|---|---|---|---|
| 2007/0199971 | A1* | 8/2007 | Chen | B25C 5/0242 227/120 |
| 2007/0267460 | A1* | 11/2007 | Popowich | B25C 5/06 227/132 |
| 2008/0290133 | A1* | 11/2008 | Shor | B25C 5/10 227/132 |
| 2009/0184150 | A1* | 7/2009 | Tsai | B25C 5/0221 227/134 |
| 2010/0264190 | A1* | 10/2010 | Tsai | B25C 5/025 227/128 |
| 2010/0314431 | A1* | 12/2010 | Wang | B25C 5/11 227/120 |
| 2011/0089217 | A1* | 4/2011 | Chen | B25C 5/0242 227/129 |
| 2013/0221057 | A1* | 8/2013 | Zhao | B25C 5/025 227/129 |
| 2013/0228605 | A1* | 9/2013 | Wang | B25C 5/11 227/8 |
| 2014/0069982 | A1* | 3/2014 | Zhao | B25C 5/06 227/132 |
| 2015/0158161 | A1* | 6/2015 | Dhillon | B25C 5/11 227/132 |
| 2015/0158162 | A1* | 6/2015 | Dhillon | B25C 5/1617 227/132 |

* cited by examiner

NAIL MACHINE WITH EFFORT-SAVING MECHANISM

BACKGROUND OF THE INVENTION

Field of the Invention

The present invention relates to a nail machine, and more particularly to a nail machine with effort-saving mechanism.

Description of the Prior Art

Usually, a conventional nail gun as disclosed in TWI413578 at least includes a pressing member, a shell, a striking board and an actuating portion. The shell includes a striking slot, and the striking board is movable along the striking slot. When the pressing member moves relative to the shell, the actuating portion actuates the striking board to move along the striking slot and strike a staple.

However, the pressing member of the above-mentioned structure usually has a longer length in order to produce greater force, and an included angle between the pressing member and the nail gun needs to be greater so as to allow a user to press the pressing member easily. The increase of the length of the pressing member and the included angle between the pressing member and the staple gun make a volume of the nail gun increase, so the nail gun occupies much space and may be inconvenient for the user to use.

The present invention has arisen to mitigate and/or obviate the afore-described disadvantages.

SUMMARY OF THE INVENTION

The major object of the present invention is to provide a nail machine with effort-saving mechanism, which has a linkage assembly to produce torque conversion so as to produce greater output force or torque output with less pressing force. In addition, the linkage assembly has at least two pivots provided for producing preferable torque conversion efficiency. An included angle between a pressing lever and a horizontal plane is smaller, so the mechanical function is enhanced, and the nail machine is easy to use and effort-saving.

To achieve the above and other objects, a nail machine with effort-saving mechanism is provided, including: a shell body; an operating mechanism, being movably pivoted to the shell body, the operating mechanism including a pressing lever, a driving rod and a linkage, an end of the pressing lever pivoted to the shell body, an end of the driving rod pivoted to the shell body, two opposites ends of the linkage pivoted to the other end of the pressing lever and the other end of the driving rod respectively, the operating mechanism being operable to move between a first position and a second position; an actuating member, pivotally disposed on the shell body, a first end and a second end of the actuating member formed with a sliding portion and an engaging portion respectively, an end of the driving rod positionably and slidably disposed on the sliding portion; a striking force accumulating mechanism, including a striking board and a force accumulating member which is connected with the striking board, the striking board being movable between an initial position and a releasing position, the force accumulating force fixedly disposed on the shell body and at least partially deformably and force-accumulatably disposed in the shell body, the striking board releasably engaged with the engaging portion; wherein when the operating mechanism moves from the first position toward the second position, the engaging portion is engaged with the striking board, and the striking board moves from the initial position toward the releasing position; and when the operating mechanism is in the second position, the engaging portion and the striking board are disengaged from each other, and the striking board moves from the releasing position toward the initial position.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Figure 1:
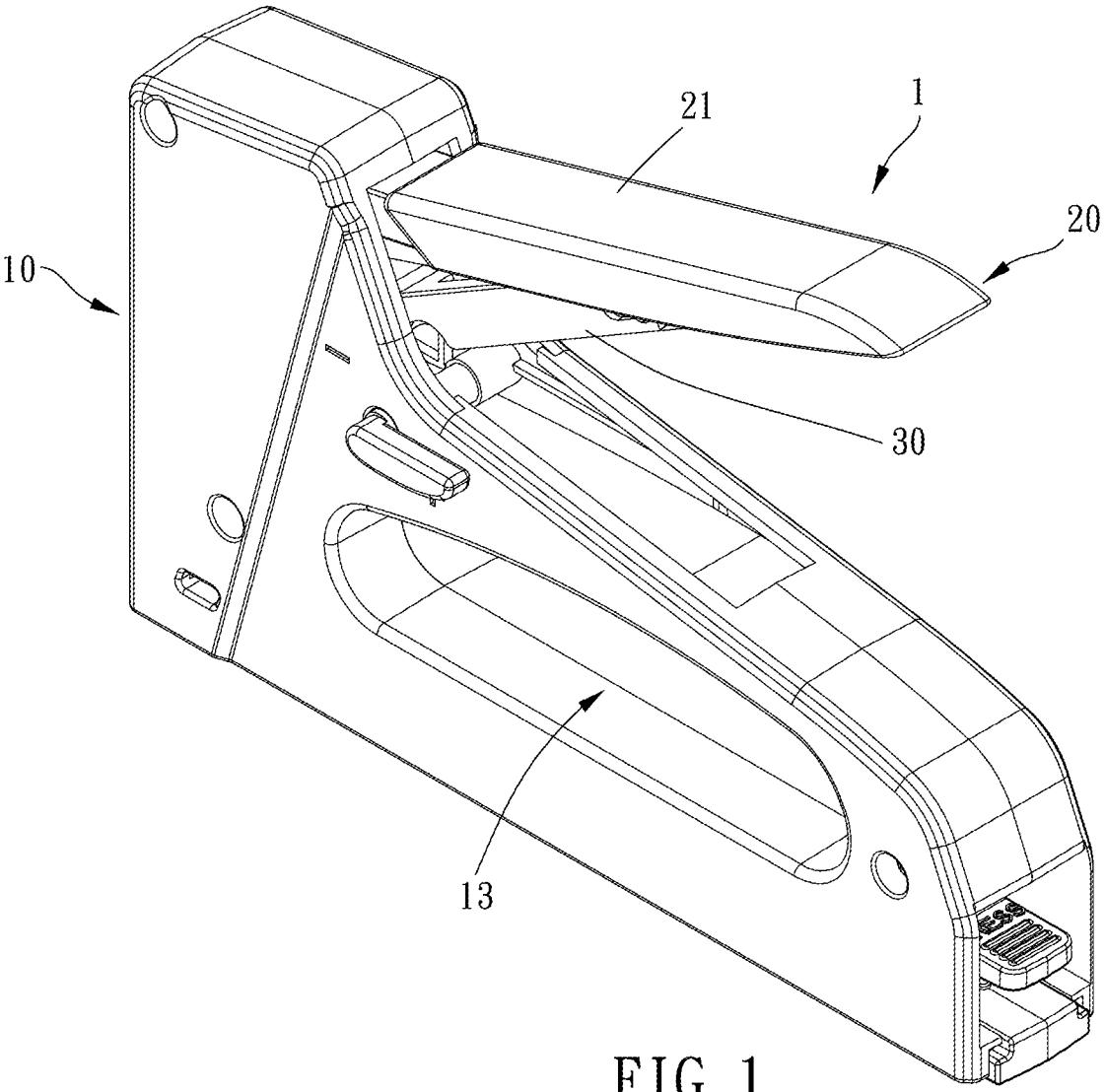
FIG. 1 is a drawing of a preferred embodiment of the present invention.
Figure 2:
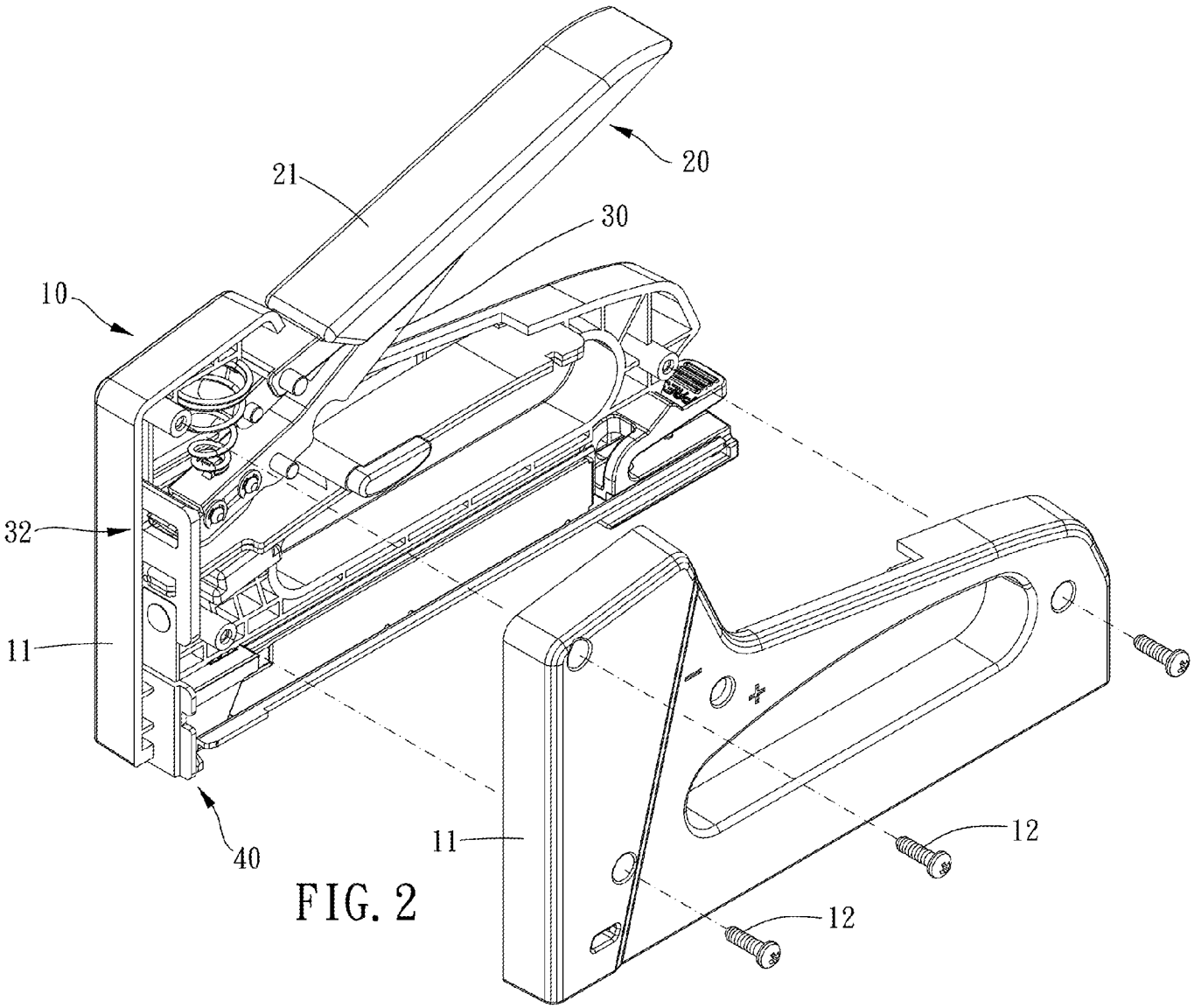
FIG. 2 is a breakdown drawing of the preferred embodiment of the present invention.
Figure 3:
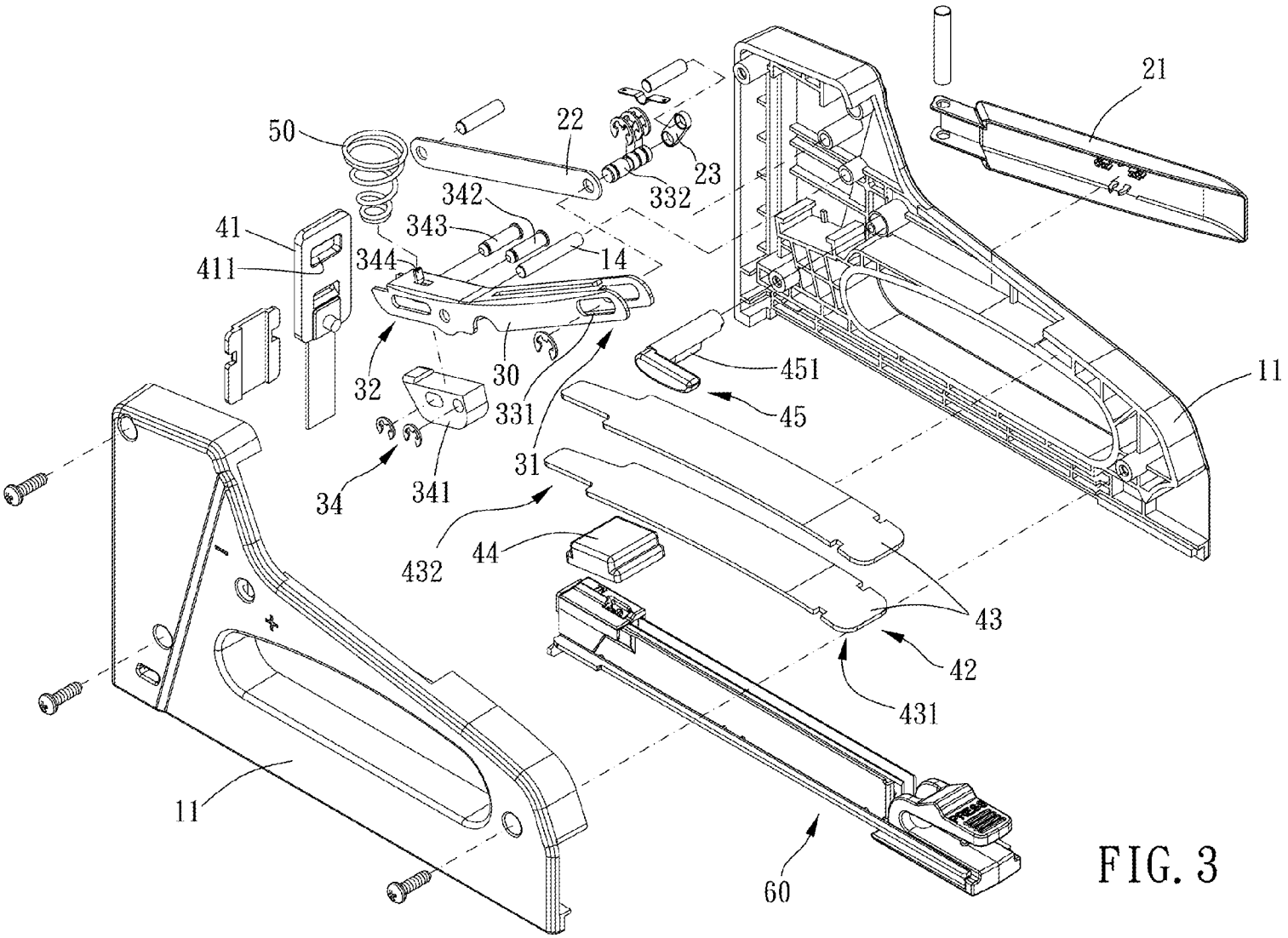
FIG. 3 is another breakdown drawing of the preferred embodiment of the present invention.

The present invention will be clearer from the following description when viewed together with the accompanying drawings, which show, for purpose of illustrations only, the preferred embodiment in accordance with the present invention.

Please refer to FIGS. 1 to 7 for a preferred embodiment of a nail machine with effort-saving mechanism 1 of the present invention. The nail machine with effort-saving mechanism 1 includes a shell body 10, an operating mechanism 20, an actuating member 30 and a striking force accumulating mechanism 40.

Figure 4:
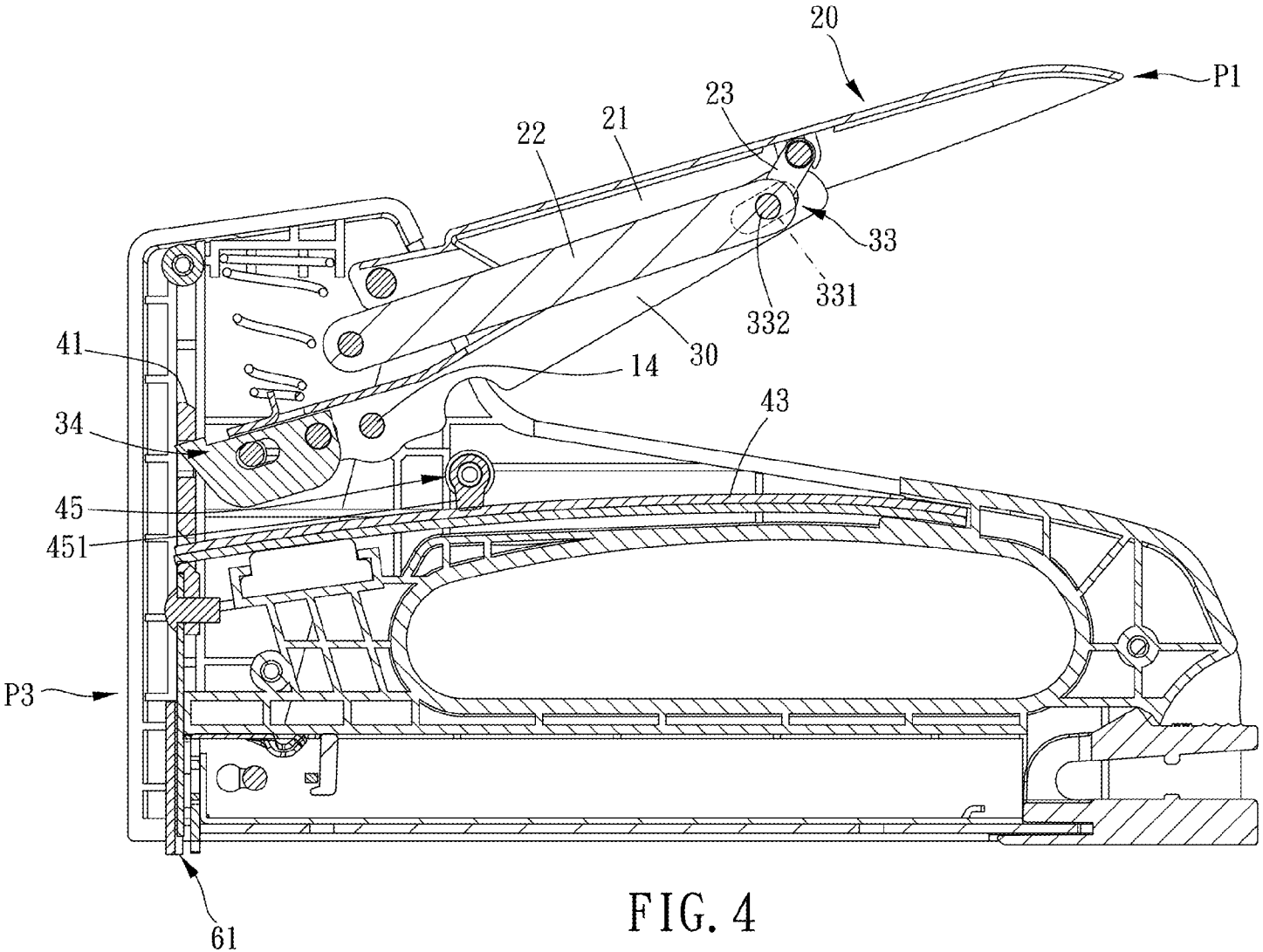
FIG. 4 is a first cross-sectional drawing of the preferred embodiment of the present invention.
Figure 5:
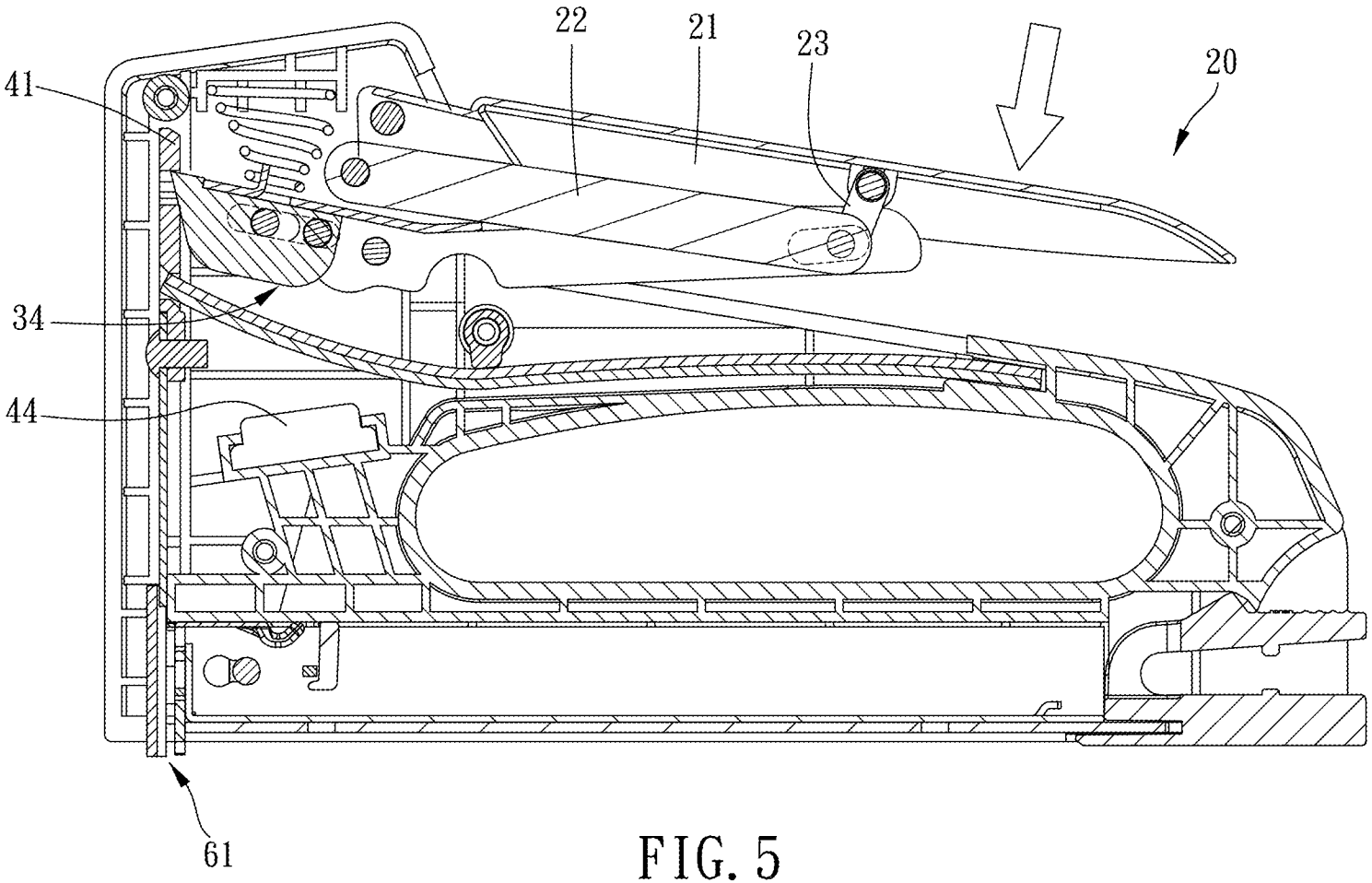
FIG. 5 is a second cross-sectional drawing of the preferred embodiment of the present invention.
Figure 6:
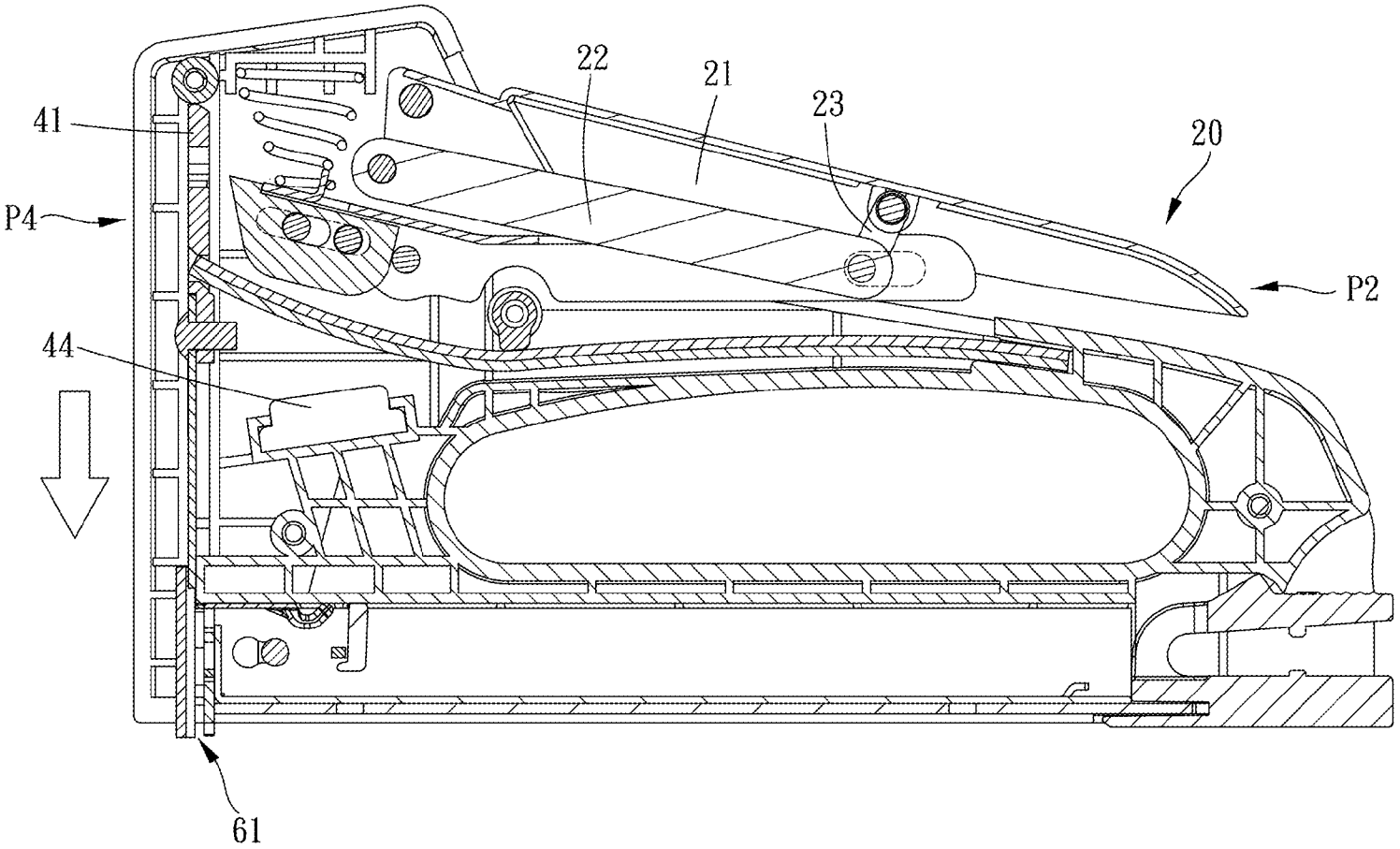
FIG. 6 is a third cross-sectional drawing of the preferred embodiment of the present invention.
Figure 7:
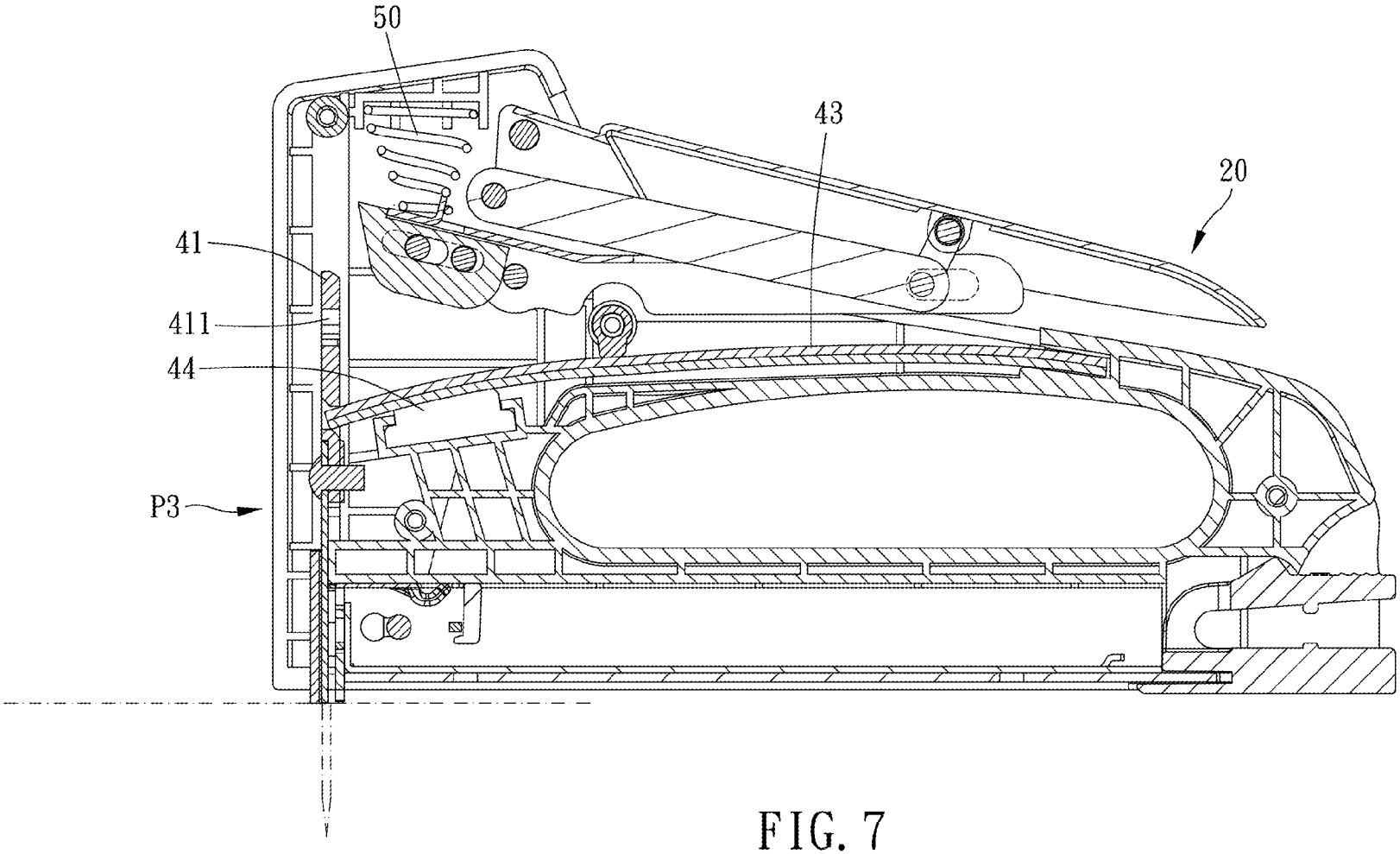
FIG. 7 is a fourth cross-sectional drawing of the preferred embodiment of the present invention.

The shell body 10 includes two shells 11 which can be assembled with each other, and the two shells 11 can be fixedly assembled with each other via a screw 12. The shell body 10 further includes a grip portion 13 for a user to grip on or apply force to. The operating mechanism 20 is movably pivoted to the shell body 10. The operating mechanism 20 is a linkage assembly and at least includes a pressing lever 21, a driving rod 22 and a linkage 23 (in other embodiments, the linkage assembly can be a plurality of rod members pivoted to one another), an end of the pressing lever 21 is pivoted to the shell body 10, an end of the driving rod 22 is pivoted to the shell body 10, and two opposite ends of the linkage 23 are pivoted to the other end of the pressing lever 21 and the other ends of the driving rod 22 respectively. The operating mechanism 20 is operable to move between a first position P1 (as shown in FIG. 4) and a second position (as shown in FIG. 6). For example, the pressing lever 21 can be pressed by the user to actuate the linkage assembly of the operating mechanism 20 to reciprocate between the first position P1 and the second position P2. It is to be noted that the pressing lever 21 is greater than the driving rod 22 in length. When the user presses and operates the operating mechanism 20, through a torque conversion of the linkage assembly, the user can produce greater output force (or torque) with less pressing force. Specifically, in this embodiment, the pressing lever 21 is a force input end (for the user to press on and apply force to), and the driving rod 22 is a force output end (for driving, for example, the actuating member 30). The pressing lever 21 and the driving rod 22 have a pivot (at a position pivoted to the shell body 10) respectively. Through adjusting the pivots of the pressing lever 21 and the driving rod 22 (for example, adjusting the positions of the pivots), the user can be provided with a preferable torque conversion efficiency; therefore, an included angle between the pressing lever 21 and a horizontal plane can be smaller, so the mechanical function is enhanced, and the nail machine is easy to use and effort-saving.

The actuating member 30 is pivotally disposed on the shell body 10, and a first end 31 and a second end 32 of the actuating member 30 are formed with a sliding portion 33 and an engaging portion 34 respectively. An end of the driving rod 22 is positionably and slidably disposed on the sliding portion 33. For example, in this embodiment, the sliding portion 33 includes a sliding slot 331 and a rolling member 332, and the rolling member 332 is pivoted with the driving rod 22 and positionably and slidably disposed in the sliding slot 331. Specifically, the driving rod 22 actuates the actuating member 30 via the sliding portion 33, a pivoting rod 14 is fixedly connected to the shell body 10, the actuating member 30 is sleeved on the pivoting rod 14, and the sliding portion 33 and the engaging portion 34 of the actuating member 30 are disposed on two opposite sides of the pivoting rod 14 respectively. When the sliding portion 33 of the actuating member 30 is abutted by the driving rod 22, the engaging portion 34 of the actuating member 30 pivotally swings about the pivoting rod 14. Preferably, a linear distance between the sliding portion 33 and the pivoting rod 14 is greater than a linear distance between the engaging portion 34 and the pivoting rod 14; and when the sliding portion 33 is pushed by a predetermined force, the engaging portion 34 produces greater torque relative to the sliding portion 33 (lever principle).

The striking force accumulating mechanism 40 includes a striking board 41 and a force accumulating member 42 which is connected with the striking board 41. The force accumulating member 42 is fixedly disposed on the shell body 10 and at least partially force-accumulatably and deformably disposed in the shell body 10. For example, the force accumulating member 42 may be at least one elastic board 43, the elastic board 43 has a fixing end 431 and a movable end 432, the fixing end 431 is fixedly disposed on the shell body 10, the movable end 432 is engaged with the striking board 41, the striking board 41 is movable between an initial position P3 and a releasing position P4, and the movable end 432 is deformed by the striking board 41 to accumulate elastic force. More specifically, after the movable end 432 deforms, the movable end 432 exerts elastic force on the striking board 41 for actuating the striking board 41 to strike. The at least one elastic board 43 may include a plurality of the elastic boards 43 which are stacked with each other (in this embodiment, there are two elastic boards 43), and increase of a number of the elastic boards 43 can enhance the force accumulating effect of the striking force accumulating mechanism 40 and make the striking board 41 produce a greater striking force.

Furthermore, the striking board 41 is releasably engaged with the engaging portion 34. For example, the engaging portion 34 includes an engaging member 341, a fixing pin 342 and a movable pin 343. The fixing pin 342 is fixedly disposed through the engaging member 341, and the movable pin 343 is movably disposed through the engaging member 341. The fixing pin 342 and the movable pin 343 are slidably disposed at the second end 32 of the actuating member 30 and adjacent to each other, and the engaging member 341 is partially protrudable and slidably disposed at the second end 32 of the actuating member 30 to allow the engaging member 341 to be releasably connected with the striking board 41. Specifically, an end of the engaging member 341 protrudably extends into an opening 411 of the striking board 41 to be engaged with the opening 411, so the striking board 41 is co-movable with the engaging portion 34. When the engaging portion 34 and the striking board 41 move to a predetermined position (for example, the releasing position P4), the engaging member 341 is disengaged from the opening 411 of the striking board 41. The nail machine 1 further includes an elastic member 50, and two opposite ends of the elastic member 50 elastically abut against the shell body 10 and a side of the actuating member 30 adjacent to the engaging portion 34 respectively. The side of the actuating member 30 has a protruding rib 344, and the elastic member 50 is sleeved on the protruding rib 344 to position the elastic member 50. The elastic member 50 is elastic and has a tendency to move the engaging portion 34 substantially toward the striking board 41.

In actual practice, when the operating mechanism 20 is pressed to move from the first position P1 toward the second position P2, the engaging portion 34 abuts against the striking board 41, and the striking board 41 moves from the initial position P3 toward the releasing position P4. Specifically, the operating mechanism 20 actuates the actuating member 30 and co-moves the striking board 41. When the striking board 41 moves, the elastic board 43 is deformed by the striking board 41 to accumulate elastic force for striking, for example, a staple. When the operating mechanism 20 is operated to move to the second position P2, the striking board 41 moves to the releasing position P4, the engaging portion 34 and the striking board 41 are disengaged from each other, and the elastic board 43 makes the striking board 41 move from the releasing position P4 toward the initial position P3 for striking the staple. The striking force accumulating mechanism 40 further includes a buffering block 44. The buffering block 44 is fixedly disposed on the shell body 10, and the buffering block 44 is located below the elastic board 43 and adjacent to the movable end 432. Preferably, when the striking board 41 moves from the releasing position P4 toward the initial position P3, the buffering block 44 and the elastic board 43 abut against each other to produce a buffering effect so as to prevent elements from being damaged. The striking force accumulating mechanism 40 further includes an adjusting member 45, and the adjusting member 45 is pivotally disposed on the shell body 10. A side of the adjusting member 45 is formed with a protrusion 451, and the adjusting member 45 is provided for being rotated and positioned in an abutting position. When the adjusting member 45 is in the abutting position, the protrusion 451 abuts against a side of the elastic board 43 to allow the elastic board 43 to deform more obviously and allow the striking board 41 to produce greater striking force so as to adjust and produce different striking forces. The nail machine 1 further includes a staple cartridge 60, and the staple cartridge 60 is disposed on a bottom side of the shell body 10. An end of the staple cartridge 60 has a stricken slot 61, and the staple cartridge 60 further includes a plurality of staples arranged in the staple cartridge 60. The staples have a tendency to move toward the stricken slot 61.

The striking board 41 is straightly disposed in the stricken slot 61 and able to strike the staples.

Figure 8:
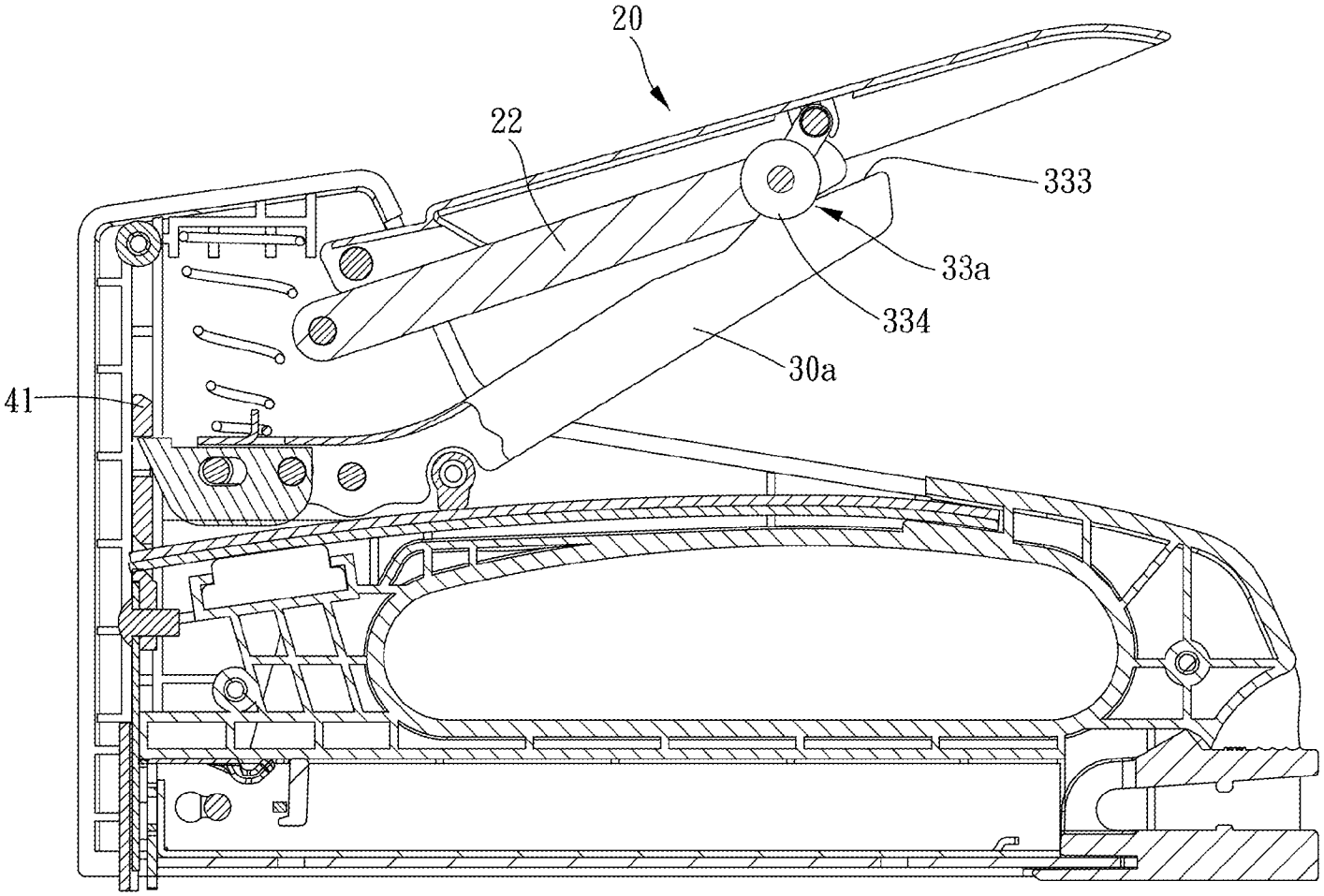
FIG. 8 is a drawing of another embodiment of the present invention.

In another embodiment as shown in FIG. 8, a sliding portion 33*a* includes an abutting face 333 and a roller 334. The roller 334 is pivoted to the driving rod 22 and slidably abuts against the abutting face 333. The operating mechanism 20 can drive an actuating member 30*a* via the sliding portion 33*a* so as to actuate the striking board 41 to strike.

Figure 9:
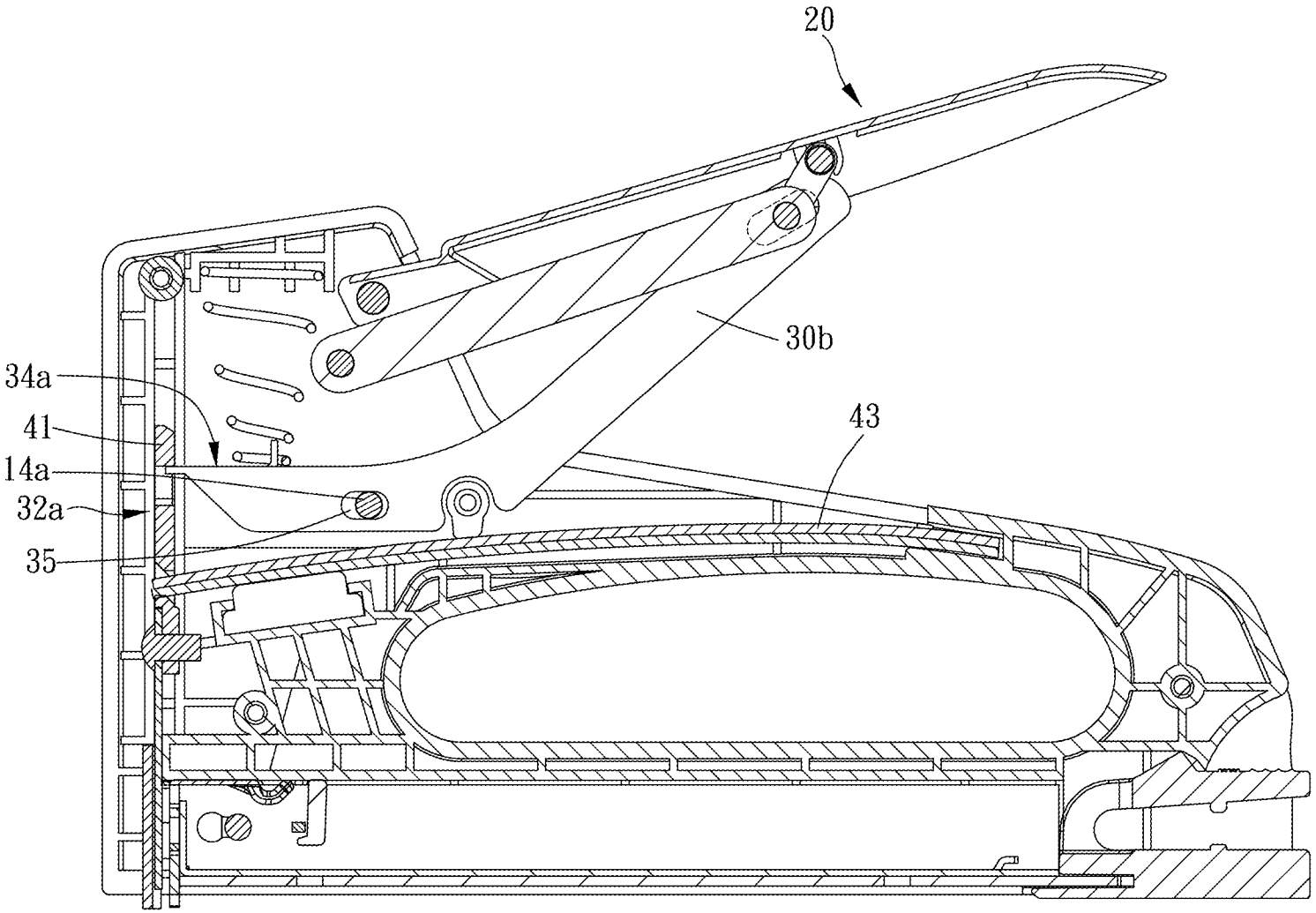
FIG. 9 is a drawing of still another embodiment of the present invention.

In still another embodiment as shown in FIG. 9, an engaging portion 34*a* is integrally and extendingly disposed at a second end 32*a* of the actuating member 30*b*, and the actuating member 30*b* has a slidable rolling portion 35. A pivoting rod 14*a* is fixedly connected to the shell body, and the slidable rolling portion 35 is slidably and pivotally sleeved on the pivoting rod 14*a*. When the operating mechanism 20 is pressed to move from the first position P1 toward the second position P2, the engaging portion 34*a* is engaged with the striking board 41, and the striking board 41 moves from the initial position P3 toward the releasing position P4. When the operating mechanism 20 is operated to move to the second position P2, the engaging portion 34*a* and the striking board 41 are disengaged from each other, and the elastic board 43 makes the striking board 41 move from the releasing position P4 toward the initial position P3 for striking the staple.

Given the above, a nail machine with effort-saving mechanism of the present invention has the linkage assembly to produce torque conversion, so the user can produce greater output force or torque output with less pressing force. In addition, the linkage assembly has at least two pivots for preferable torque conversion efficiency. Furthermore, an included angle between a pressing lever and a horizontal plane is smaller, so the overall mechanical advantage is enhanced, and the nail machine is easy to use and effort-saving.

While we have shown and described various embodiments in accordance with the present invention, it should be clear to those skilled in the art that further embodiments may be made without departing from the scope of the present invention.

What is claimed is:

1. A nail machine with an effort-saving mechanism, including:

a shell body;

an operating mechanism, being movably pivoted to the shell body, the operating mechanism including a pressing lever, a driving rod and a linkage, an end of the pressing lever pivoted to the shell body, an end of the driving rod pivoted to the shell body, two opposite ends of the linkage pivotally connected with the other end of the pressing lever and the other end of the driving rod respectively, the operating mechanism being operable to move between a first position and a second position;

an actuating member, being pivoted to the shell body, a first end and a second end of the actuating member having a sliding portion and an engaging portion respectively, an end of the driving rod positionably and slidably disposed on the sliding portion;

a striking force accumulating mechanism, including a striking board and a force accumulating member which is connected with the striking board, the striking board being movable between an initial position and a releasing position, the force accumulating member fixedly disposed on the shell body and at least partially deformably and force-accumulatably disposed in the shell body, the striking board releasably engaged with the engaging portion;

wherein when the operating mechanism moves from the first position toward the second position, the engaging portion is engaged with the striking board, and the striking board moves from the initial position toward the releasing position; and when the operating mechanism is in the second position, the engaging portion and the striking board are disengaged from each other, and the striking board moves from the releasing position toward the initial position.

2. The nail machine with effort-saving mechanism of claim 1, wherein the force accumulating member is an elastic board, the elastic board has a fixing end and a movable end, the fixing end is fixedly disposed on the shell body, the movable end is engaged with the striking board, and the movable end is deformed by the striking board to accumulate elastic force.

3. The nail machine with effort-saving mechanism of claim 2, wherein the striking force accumulating mechanism further includes a buffering block, the buffering block is fixedly disposed on the shell body, and the buffering block is located below the elastic board and adjacent to the movable end.

4. The nail machine with effort-saving mechanism of claim 2, wherein the striking force accumulating mechanism further includes an adjusting member, the adjusting member is pivoted to the shell body, a side of the adjusting member is formed with a protrusion, the adjusting member is provided for being rotated and positioned in an abutting position, and when the adjusting member is positioned in the abutting position, the protrusion abuts against a side of the elastic board.

5. The nail machine with effort-saving mechanism of claim 1, wherein the sliding portion includes a sliding slot and a rolling member, and the rolling member and the driving rod are pivoted with each other and positionably slidably disposed in the sliding slot.

6. The nail machine with effort-saving mechanism of claim 1, wherein the sliding portion includes an abutting face and a roller, and the roller is pivoted to the driving rod and slidably abuts against the abutting face.

7. The nail machine with effort-saving mechanism of claim 1, wherein the engaging portion includes an engaging member, a fixing pin and a movable pin, the fixing pin is fixedly disposed through the engaging member, the movable pin is movably disposed through the engaging member, the fixing pin and the movable pin are slidably disposed at the second end of the actuating member and adjacent to each other, the engaging member is partially protrudable and slidably disposed at the second end of the actuating member, and the engaging member is releasably engaged with the striking board.

8. The nail machine with effort-saving mechanism of claim 1, wherein the engaging portion is integrally and extendingly disposed at the second end of the actuating member, the actuating member has a slidable rolling portion, a pivoting rod is fixedly connected to the shell body, and the slidable rolling portion is slidably and pivotally sleeved on the pivoting rod.

9. The nail machine with effort-saving mechanism of claim 1 further including an elastic member, two opposite ends of the elastic member elastically abutting against the shell body and a side of the actuating member adjacent to the engaging portion respectively, the side of the actuating member having a protruding rib, the elastic member sleeved on the protruding rob, the engaging portion having a tendency to move substantially toward the striking board.

10. The nail machine with effort-saving mechanism of claim 1 further including a staple cartridge, the staple cartridge disposed on a bottom side of the shell body, an end of the staple cartridge having a stricken slot, the striking board straightly disposed in the stricken slot, the staple cartridge further including a plurality of staples arranged in the staple cartridge, the staples having a tendency to move toward the stricken slot.

* * * * *